US006612833B1

(12) United States Patent
Pötzl

(10) Patent No.: US 6,612,833 B1
(45) Date of Patent: Sep. 2, 2003

(54) REGENERATIVE AFTERBURNER

(75) Inventor: Walter Pötzl, Ammerbuch (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 09/857,324

(22) PCT Filed: Sep. 21, 2000

(86) PCT No.: PCT/EP00/09244

§ 371 (c)(1),
(2), (4) Date: May 31, 2001

(87) PCT Pub. No.: WO01/25692

PCT Pub. Date: Apr. 12, 2001

(30) Foreign Application Priority Data

Oct. 6, 1999 (DE) ..... 199 48 212

(51) Int. Cl.[7] ..... F23D 11/44
(52) U.S. Cl. ..... 431/215
(58) Field of Search ..... 431/5, 181, 215, 431/214, 216; 110/233; F23G 7/06

(56) References Cited

U.S. PATENT DOCUMENTS 5,101,741 A * 4/1992 Gross et al. ..... 110/233
5,240,403 A * 8/1993 McAnespie ..... 431/5
5,538,420 A 7/1996 Klobucar et al.
5,643,539 A 7/1997 Collard et al.
5,839,894 A * 11/1998 Schedler et al. ..... 432/181

FOREIGN PATENT DOCUMENTS

EP 0719984 A2 * 1/1995 ..... F23G/7/06
EP 0 719 984 A2 3/1996

* cited by examiner

*Primary Examiner*—Henry Bennett
*Assistant Examiner*—Sabrina Dagostino
(74) *Attorney, Agent, or Firm*—Factor & Partners

(57) ABSTRACT

A regenerative post-combustion apparatus (1) in a housing (2) in a known manner comprises from top to bottom a combustion chamber (8), a heat exchanger area (7) subdivided into a plurality of segments filled with heat exchanger material, and a rotating distributor (5). The latter depending on its rotational position establishes a connection, on the one hand, between an inlet (3) for waste gas to be cleaned and at least one first segment of the heat exchanger area (7), as well as between at least one second segment of the heat exchanger area (7) and an outlet (10) for cleaned gas. Disposed above the rotating distributor (5) is a burn-out rotary slide valve (31). The latter is subdivided by dividing walls into segments, of which one is closed in the direction of the rotating distributor (5) and communicates with an outlet (68). The other segments of the burn-out rotary slide valve (31) are open in a downward and an upward direction. The burn-out rotary slide valve (31) may be rotated in such a way that its downwardly closed segment may be brought selectively into communication with each of the segments of the heat exchanger area (7). In said segment, thermal regeneration of the heat exchanger material situated there occurs without the normal operation of waste gas cleaning having to be interrupted in the other segments.

6 Claims, 16 Drawing Sheets

REGENERATIVE AFTERBURNER

Figure 1:
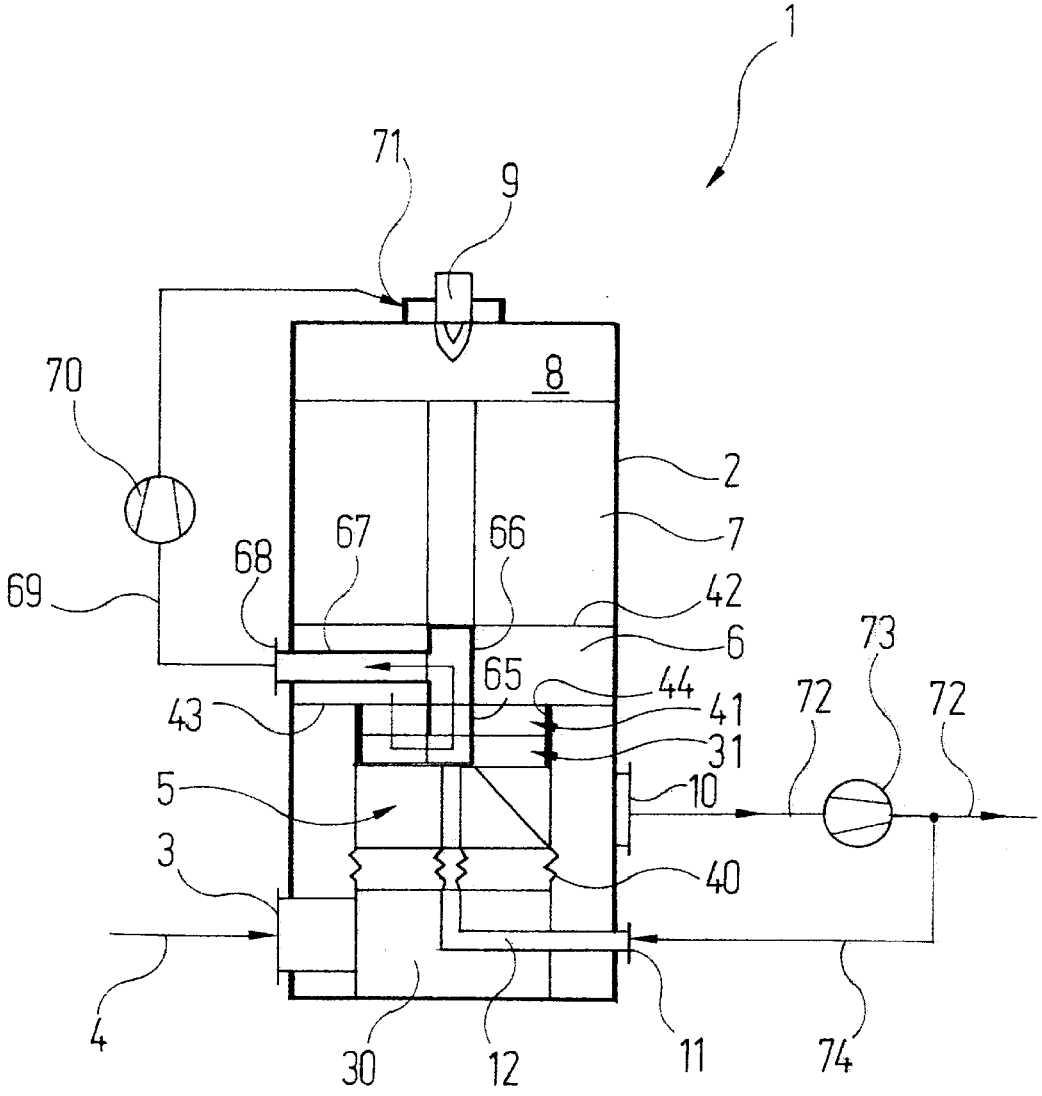

The invention relates to a regenerative post-combustion apparatus, which in a housing comprises from top to bottom:

a) a combustion chamber;

b) a heat exchanger area, which is subdivided into a plurality of segments filled with heat exchanger material;

c) a rotating distributor, which depending on its rotational position establishes:

ca) a connection between an inlet for waste gas to be cleaned and at least one first segment of the heat exchanger area;

cb) a connection between at least one second segment of the heat exchanger area and an outlet for cleaned gas, wherein a device for thermal regeneration of the heat exchanger material is provided, by means of which hot clean gas may be conveyed through selected segments of the heat exchanger area until the impurities, which have become attached to the heat exchanger material, detach from the latter.

Regenerative post-combustion apparatuses are used to clean contaminated waste gases from industrial processes. To save energy during the thermal post-combustion, the waste gases to be cleaned are conveyed through heat exchanger materials. As the waste gases to be cleaned frequently contain impurities, in particular also organic impurities in the form of condensable substances, e.g. tar products, or dusts, in the course of operation the surfaces of the heat exchanger materials become clogged with said impurities. For regeneration, the heat exchanger material periodically has to be heated up to a temperature, at which the impurities attached to the surface detach themselves and may be removed. In the present context, by "attached" impurities are meant all impurities which may attach to the heat exchanger material mechanically, chemically, through absorption, through adsorption or through condensation processes and may be removed by a thermal process combined with flow.

This occurs in the known thermal post-combustion apparatuses in that their normal operation, during which the waste gases are cleaned, is interrupted. Hot gases, which may originate e.g. from the combustion chamber, are conveyed through the individual segments of the heat exchanger material until said segments have been heated from top to bottom up to the required temperature so that all regions of the heat exchanger material in said segments are freed of impurities. The drawback of said known regenerative post-combustion apparatuses is that normal operation has to be suspended for regeneration. Thus, if a continuous cleaning operation is to be ensured, it is necessary to provide, for the downtimes of the one regenerative post-combustion apparatus, a second post-combustion apparatus lying parallel thereto.

The object of the present invention is to refine a regenerative post-combustion apparatus of the type described initially in such a way that it enables a continuous cleaning operation also during thermal regeneration of the heat exchanger material.

Said object is achieved according to the invention in that the device for thermal regeneration comprises:

d) a burn-out rotary slide valve, which is disposed above the rotating distributor and comprises segments separated by dividing walls, wherein da) at least one of the segments of the burn-out rotary slide valve is open in an upward direction and closed in the direction of the rotating distributor and communicates with an outlet, while db) the other segments of the burn-out rotary slide valve are open in an upward and downward direction;

e) a driving device, by means of which the burn-out slide valve may be rotated in such a way underneath the heat exchanger area that its downwardly closed segment may be brought selectively into communication with each segment of the heat exchanger area.

In a post-combustion apparatus according to the invention, therefore, the gas flow from the rotating distributor into the segmented heat exchanger area filled with heat exchanger material is controlled by an additional element, the "burn-out rotary slide valve". The latter in no way alters the basic mode of operation as regards waste gas cleaning compared to prior art; the only difference is that the flow path from the rotating distributor into the heat exchanger area is slightly longer compared to prior art. However, with the post-combustion apparatus according to the invention it is possible to remove an individual segment or individual segments of the heat exchanger area from the waste gas cleaning operation. For said purpose, the burn-out rotary slide valve is rotated in such a way that its downwardly closed segment communicates with the segment or segments of the heat exchanger area which is/are to be thermally regenerated. The latter is/are then no longer periodically cooled by a supply of cool outgoing air. It is or they are then heated from top to bottom by the hot gas used for thermal regeneration, which is conveyed either from the combustion chamber of the regenerative post-combustion apparatus via the relevant segments of the heat exchanger area to be regenerated and via the downwardly closed segment of the burn-out slide valve to the outlet or in the reverse direction. In either case the gases, which flow through the segments of the heat exchanger area to be regenerated and through the downwardly closed segment of the burn-out slide valve, are ultimately conveyed (once more) into the combustion chamber where the impurities, which have detached from the heat exchanger material during the regeneration process, are burnt. Said operation may, where required, be carried out separately for each segment of the heat exchanger area.

When the number of segments of the heat exchanger area corresponds to the number of segments of the burn-out rotary slide valve, this means that there is always one of the segments of the heat exchanger area which is unable to participate in the waste gas cleaning operation. This is avoided in the particularly advantageous embodiment of the invention, in which the heat exchanger area is subdivided into n segments and a) the burn-out rotary slide valve is subdivided into (n+1) segments, of which n are open in an upward and downward direction and one is open in an upward direction and closed in a downward direction;

b) provided in the flow path between the burn-out rotary slide valve and the heat exchanger area is a transfer area, which ba) at its top side is subdivided into n sectors, which each enclose an angle of 360°/n and have a through-opening, which communicates with one of the n segments of the heat exchanger area;

bb) at its bottom side is subdivided into (n+1) sectors, which each enclose an angle of 360°/(n+1), wherein n of said sectors have a through-opening, which depending on the rotational position of the burn-out rotary slide valve may communicate with each of the latter's (n+1) segments, while one sector is closed and in a specific rotational position of the burn-out rotary slide valve is positioned above the latter's downwardly closed segment;

bc) has n dividing walls, which in part extend obliquely in such a manner from the top side to the bottom side of the transfer area that the latter is subdivided into n segments, which at the top and bottom side each have a through-opening, wherein at least one of said segments at its bottom side is delimited at least partially by the closed sector.

The fact, that in said embodiment of the invention the burn-out rotary slide valve has one segment more than the heat exchanger area, allows the burn-out rotary slide valve to have just as many upwardly and downwardly open segments, i.e. segments participating in the waste gas cleaning operation, as the heat exchanger area. By virtue of the trick of the so-called "transfer area" the transition is provided between the segment arrangement, such as the heat exchanger area has, and the segment arrangement provided in the burn-out rotary slide valve. The transfer area at its bottom side with the closed sector provides a surface, under which the downwardly closed segment of the burn-out rotary slide valve may be "parked" when there is to be no thermal regeneration in any segment of the heat exchanger area.

It is advantageous when the burn-out rotary slide valve comprises a central tubular piece, the interior of which communicates via an opening in its lateral surface with the downwardly closed segment of the burn-out rotary slide valve. The hot gas used for thermal regeneration is in said case supplied to, or discharged from, the burn-out rotary slide valve via the central tubular piece.

The central tubular piece of the burn-out rotary slide valve may be closed in a downward direction and communicate at the top with a coaxial central tubular piece of the above-lying component, which communicates with the connection. This means that the hot gas used for thermal regeneration is supplied from above to the burn-out rotary slide valve and discharged from the latter in an upward direction.

Alternatively, it is also possible for the central tubular piece of the burn-out rotary slide valve to be closed in an upward direction and communicate at the bottom with a coaxial central tubular piece of the component below, which communicates with the connection.

Which of the two latterly described embodiments of the invention is used will depend upon the geometric proportions of each individual case.

A further possibility of conveying the hot gas used for thermal regeneration through the burn-out rotary slide valve is such that the downwardly closed segment of the burn-out rotary slide valve has in its lateral surface an opening, via which it communicates with a stationary annular channel, which surrounds the burn-out rotary slide valve and in turn communicates with the connection. In said refinement of the invention, the hot gas used for thermal regeneration is supplied to, and discharged from, the burn-out rotary slide valve radially, which in individual cases is preferable likewise for geometric reasons.

Figure 2:
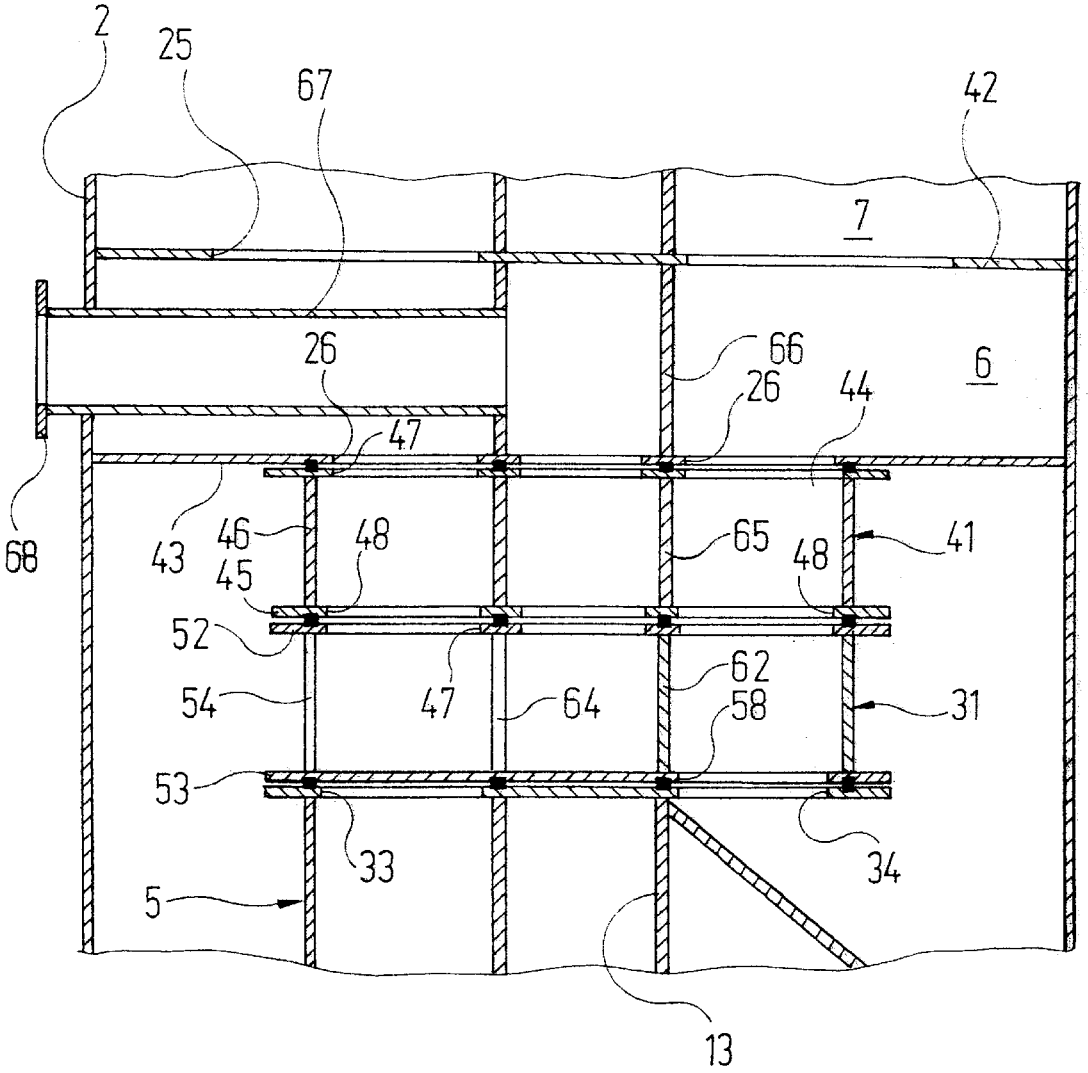
Figure 3:
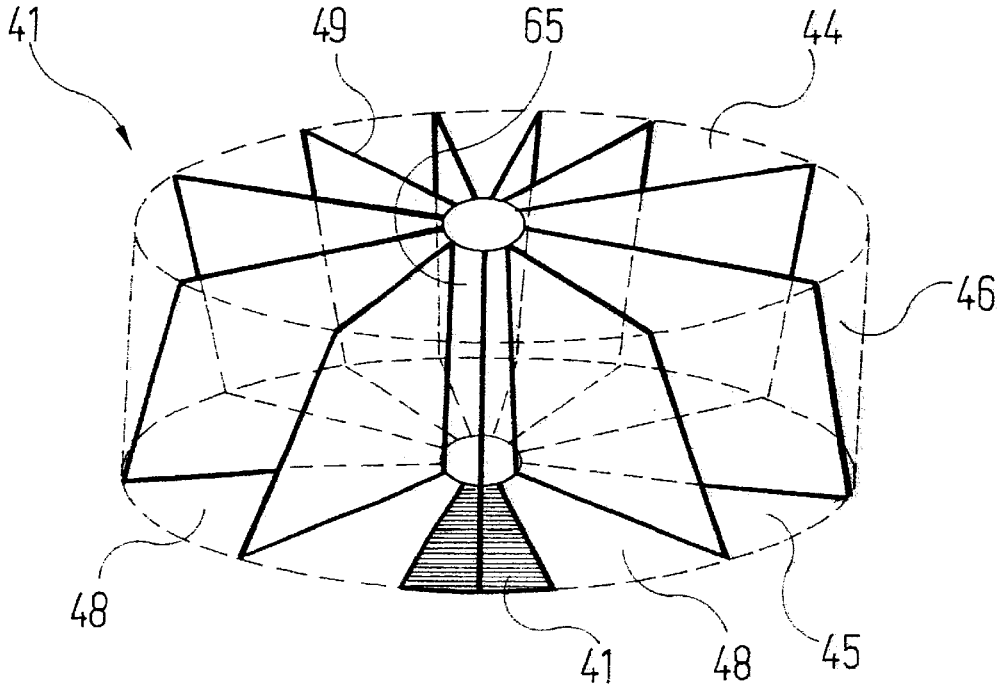
Figure 4:
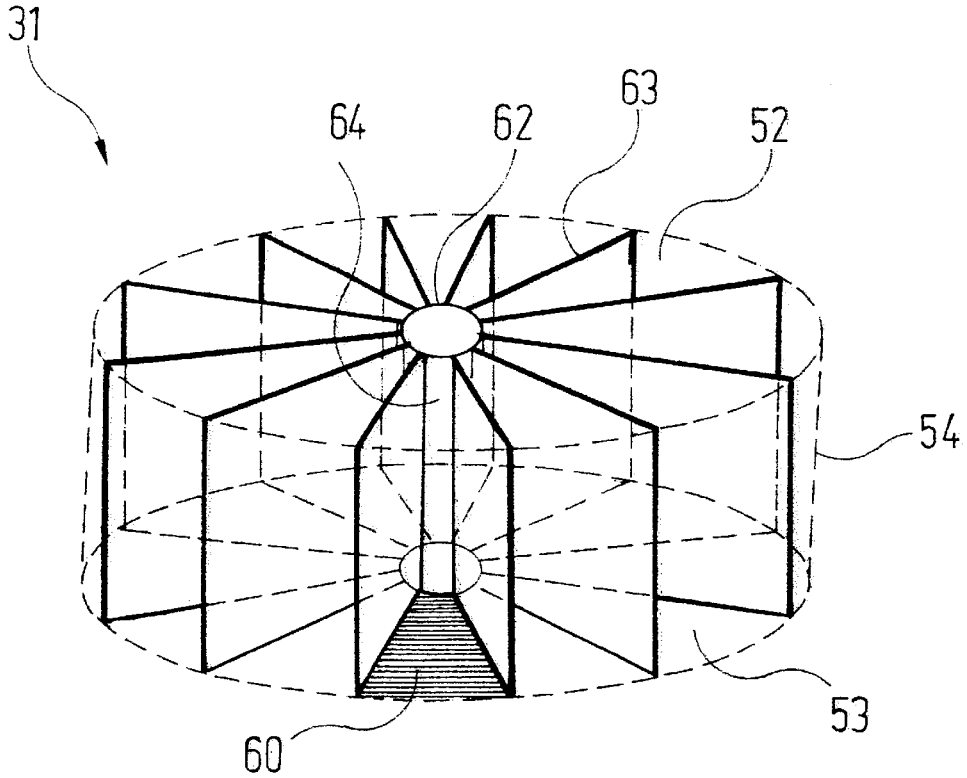
Figure 5:
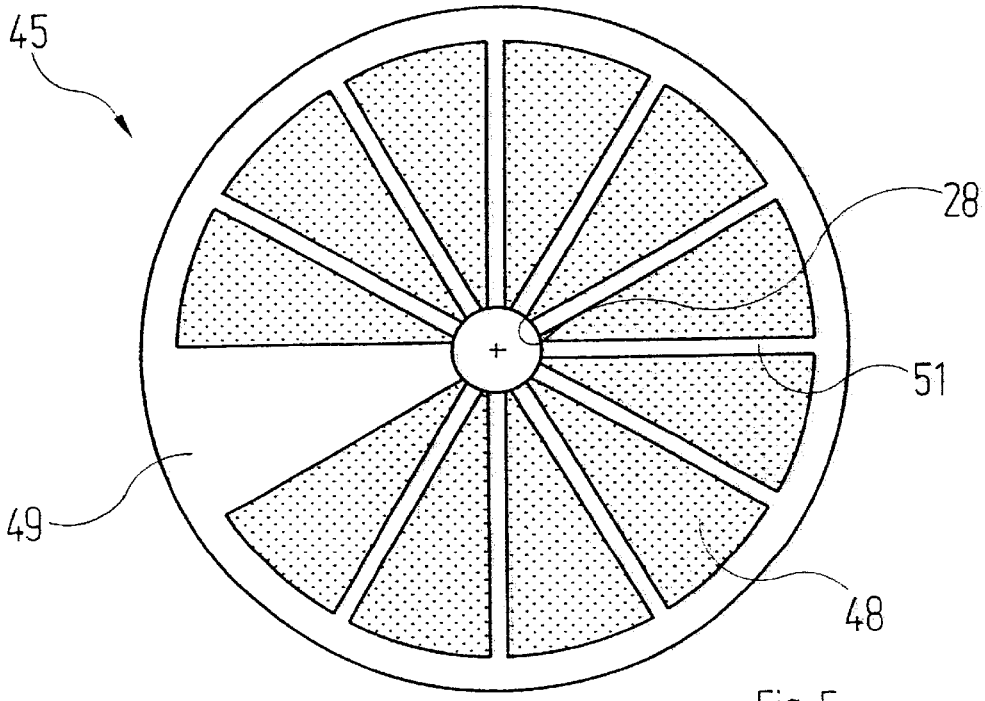
Figure 6:
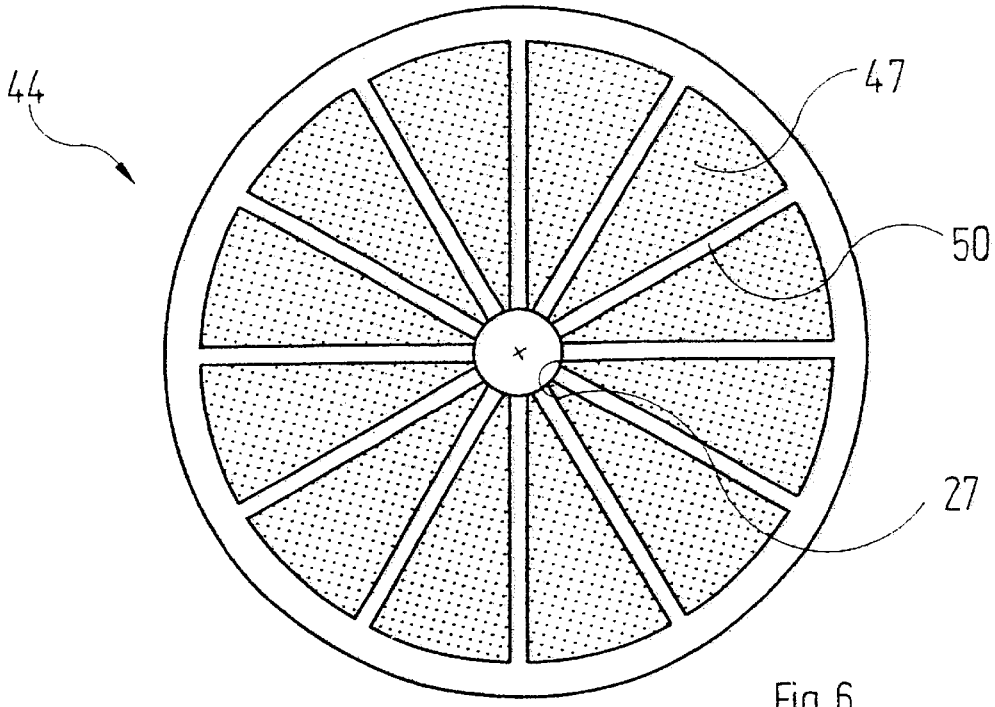
Figure 7:
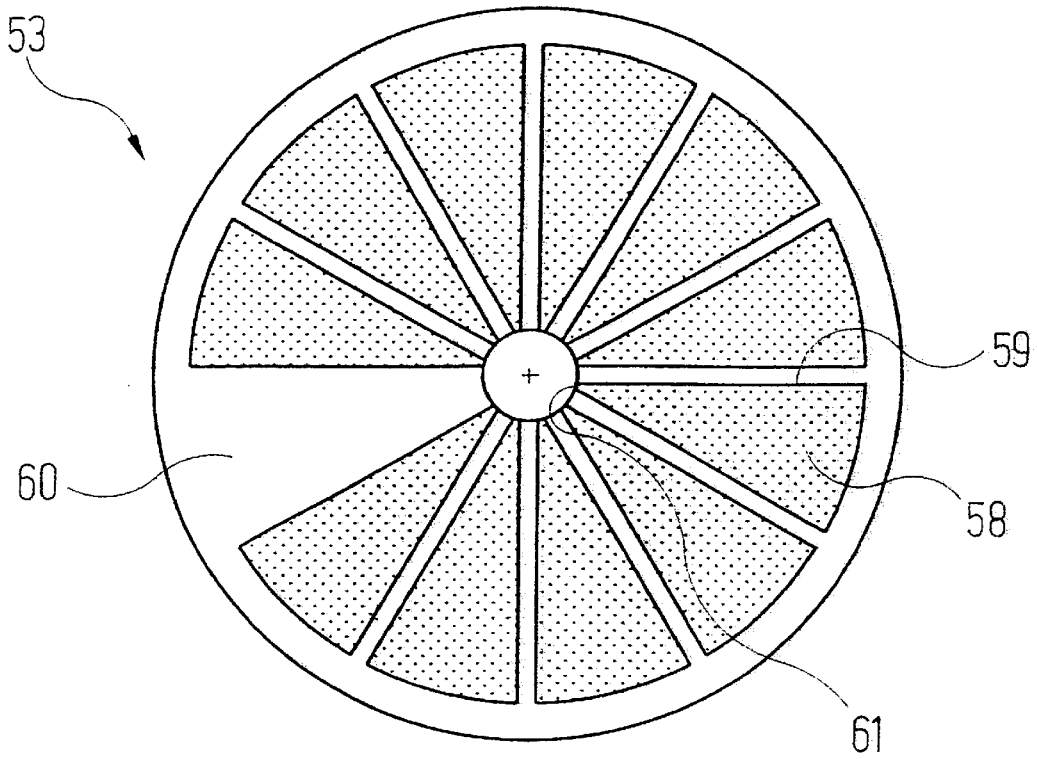
Figure 8:
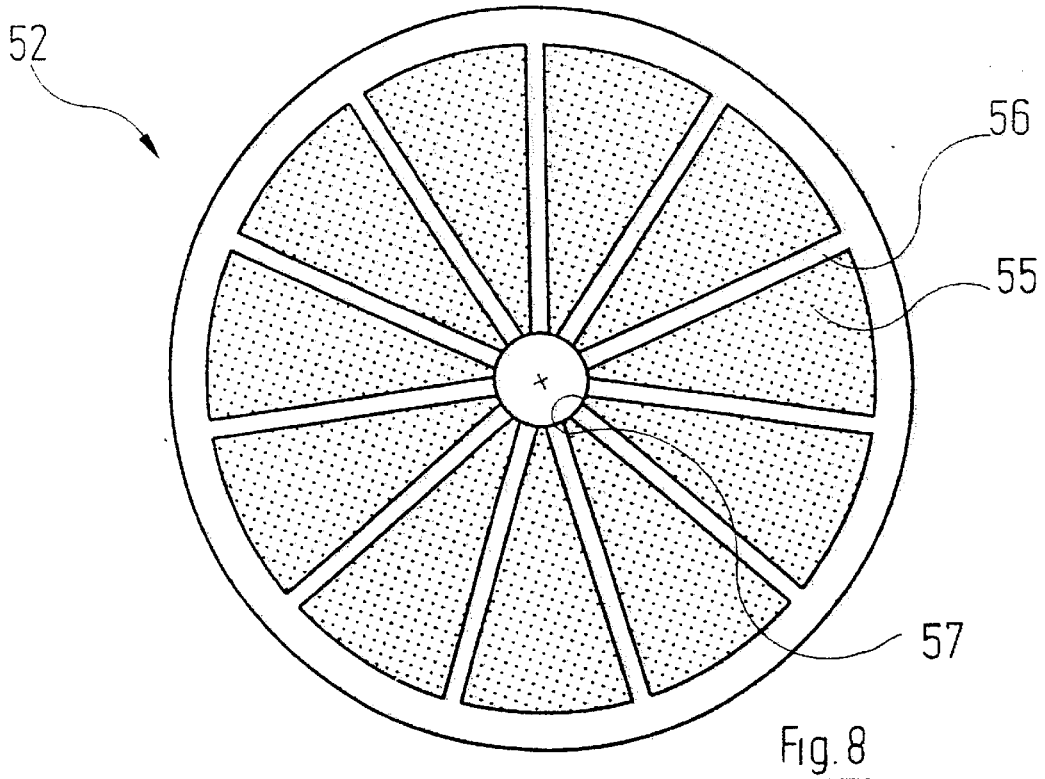
Figure 9:
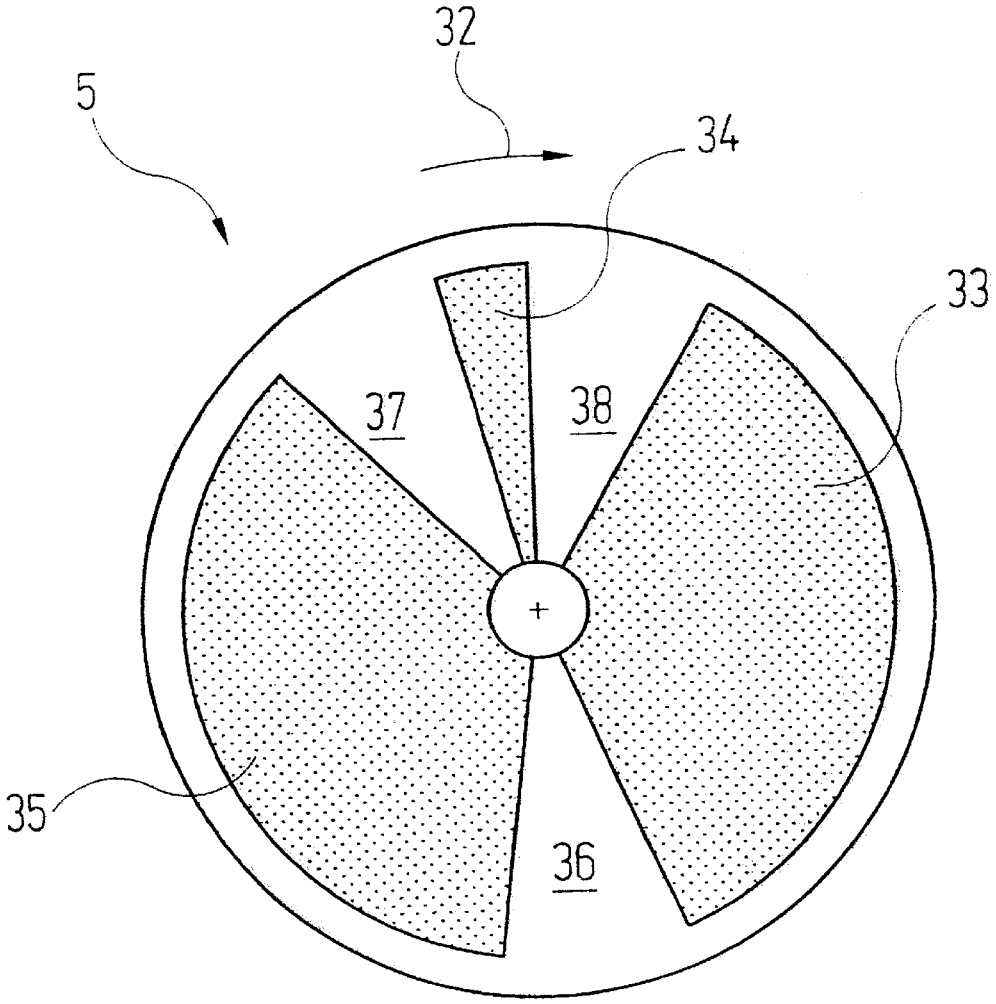
Figure 10:
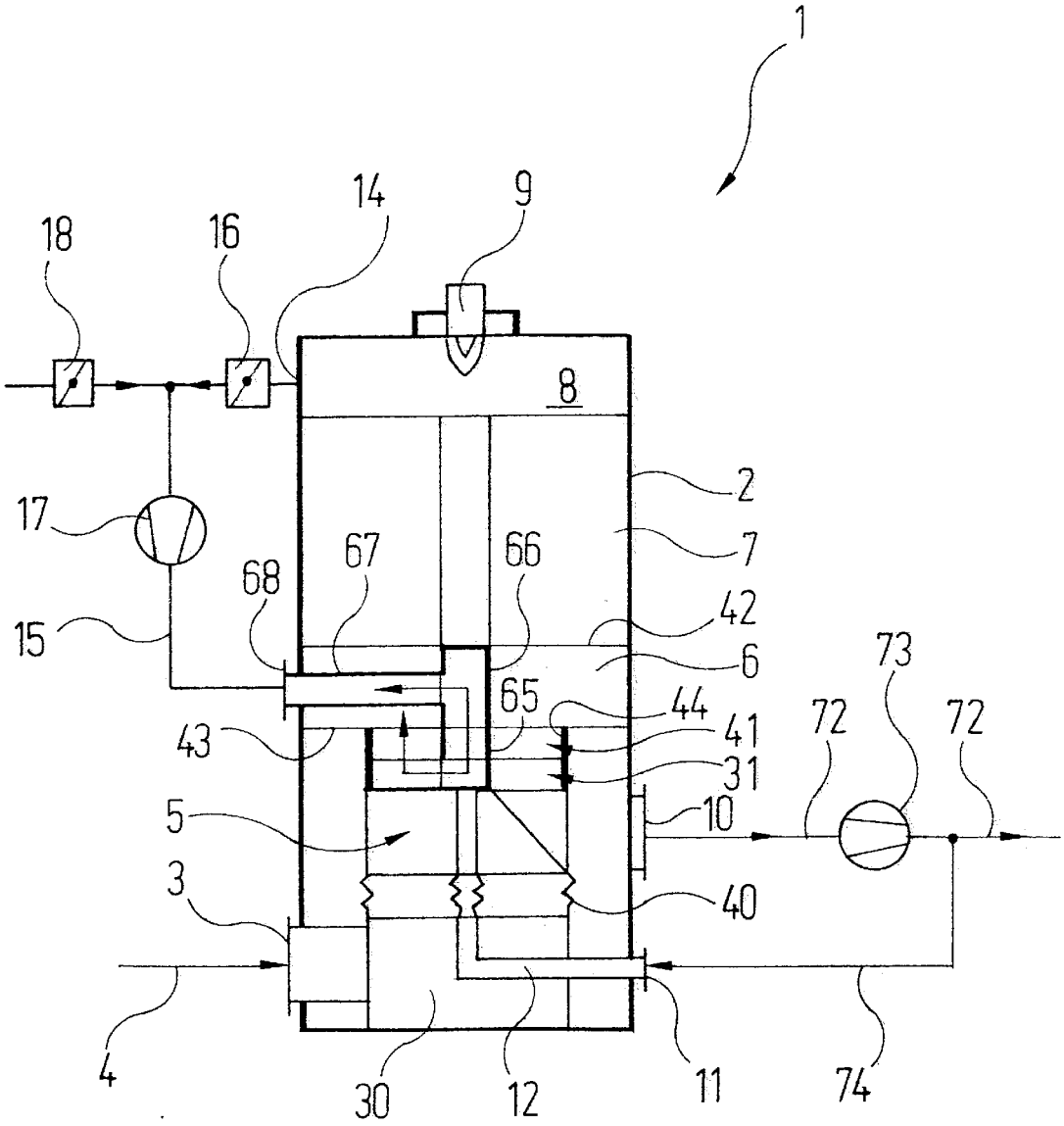
Figure 11:
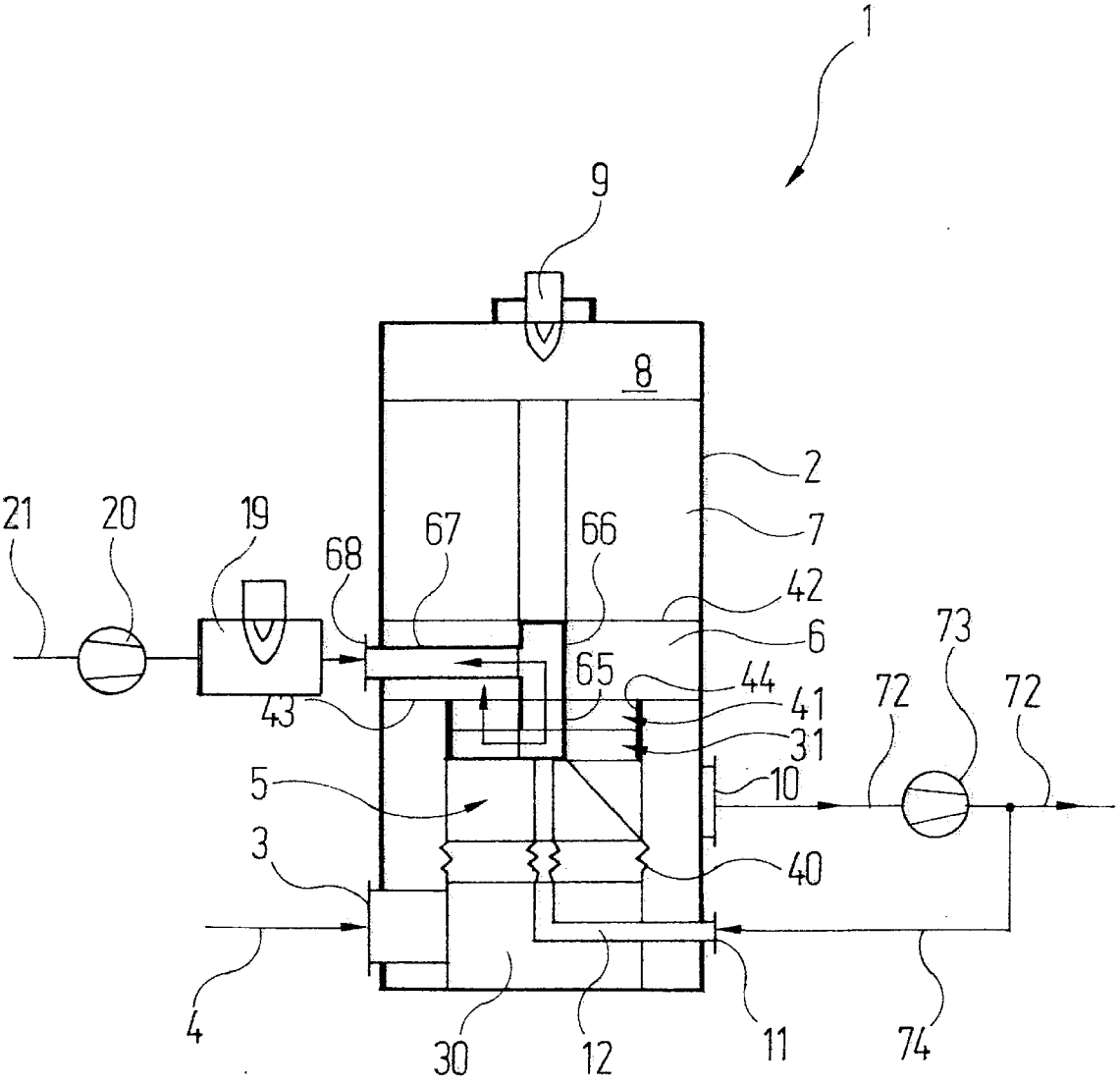
Figure 12:
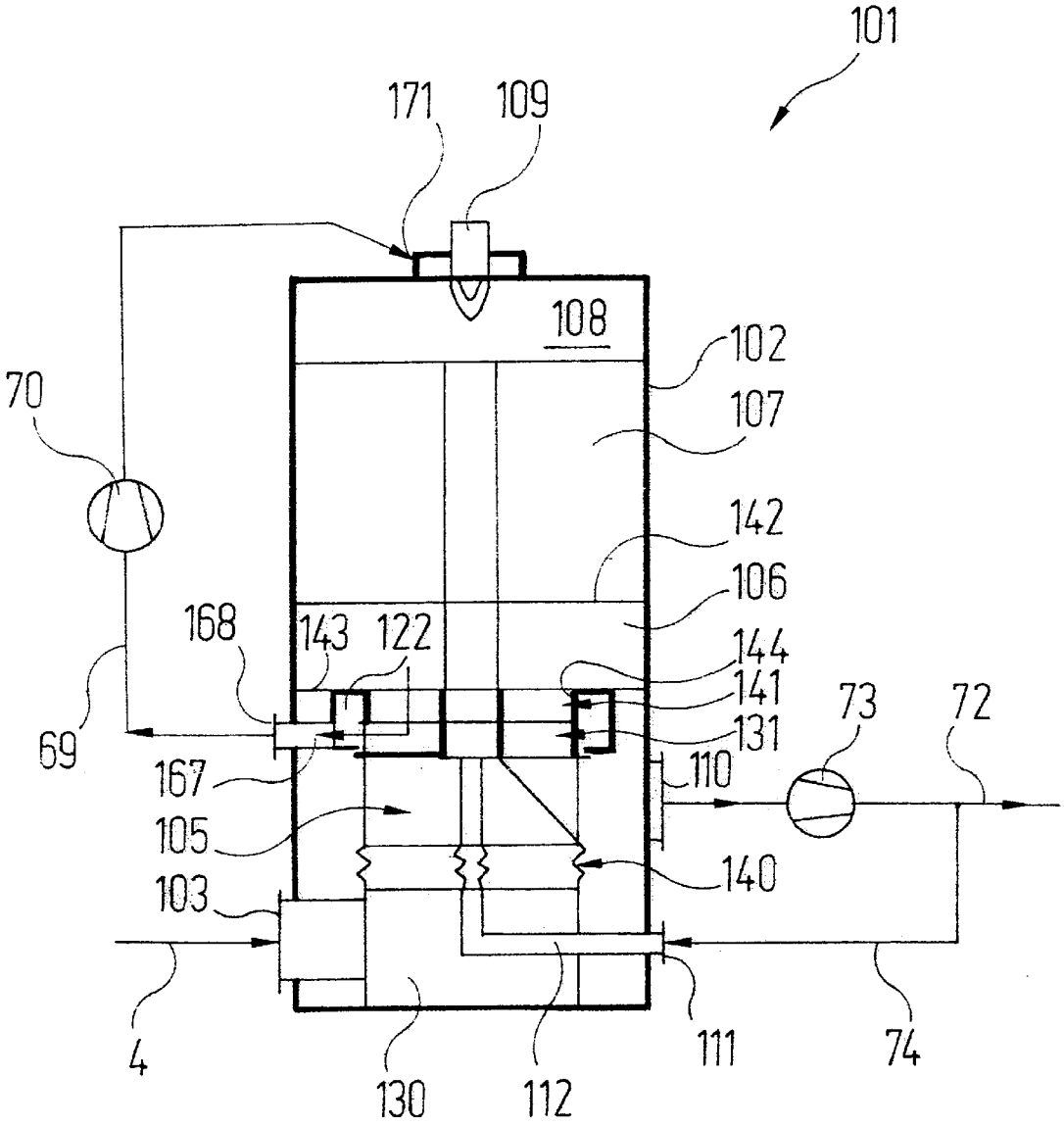
Figure 13:
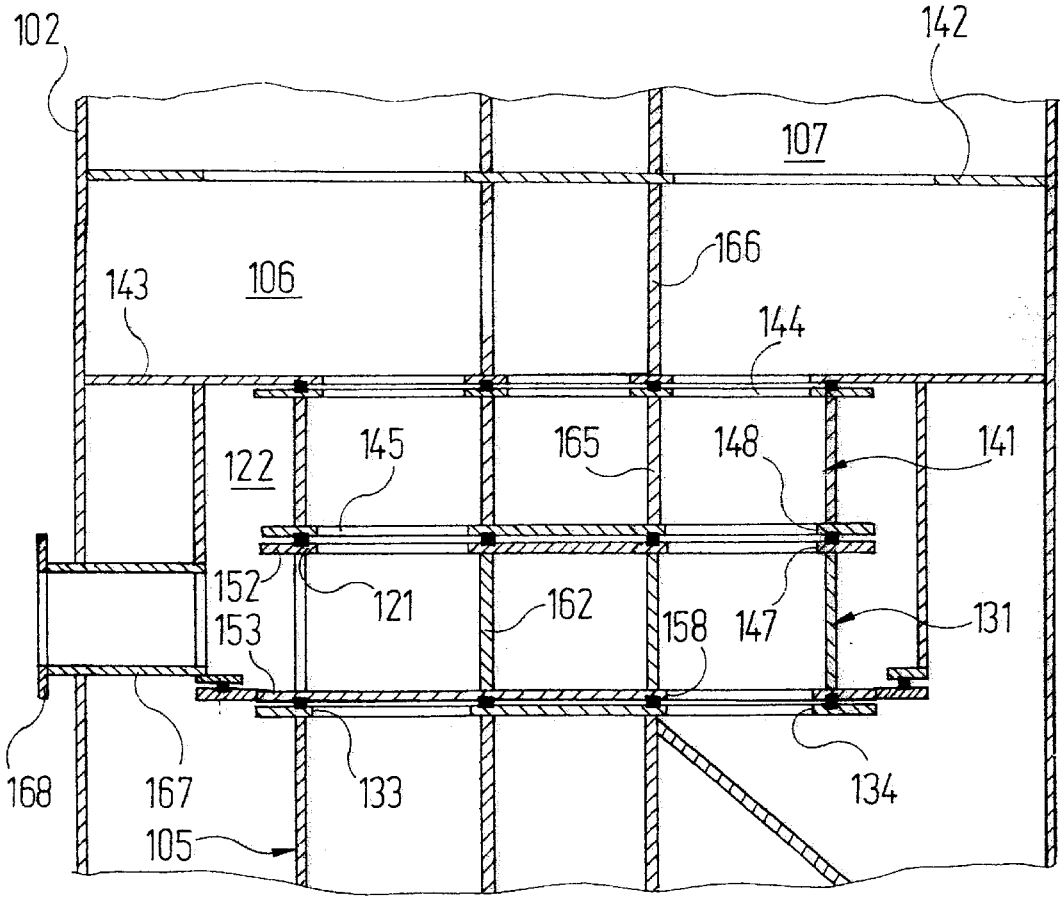
Figure 14:
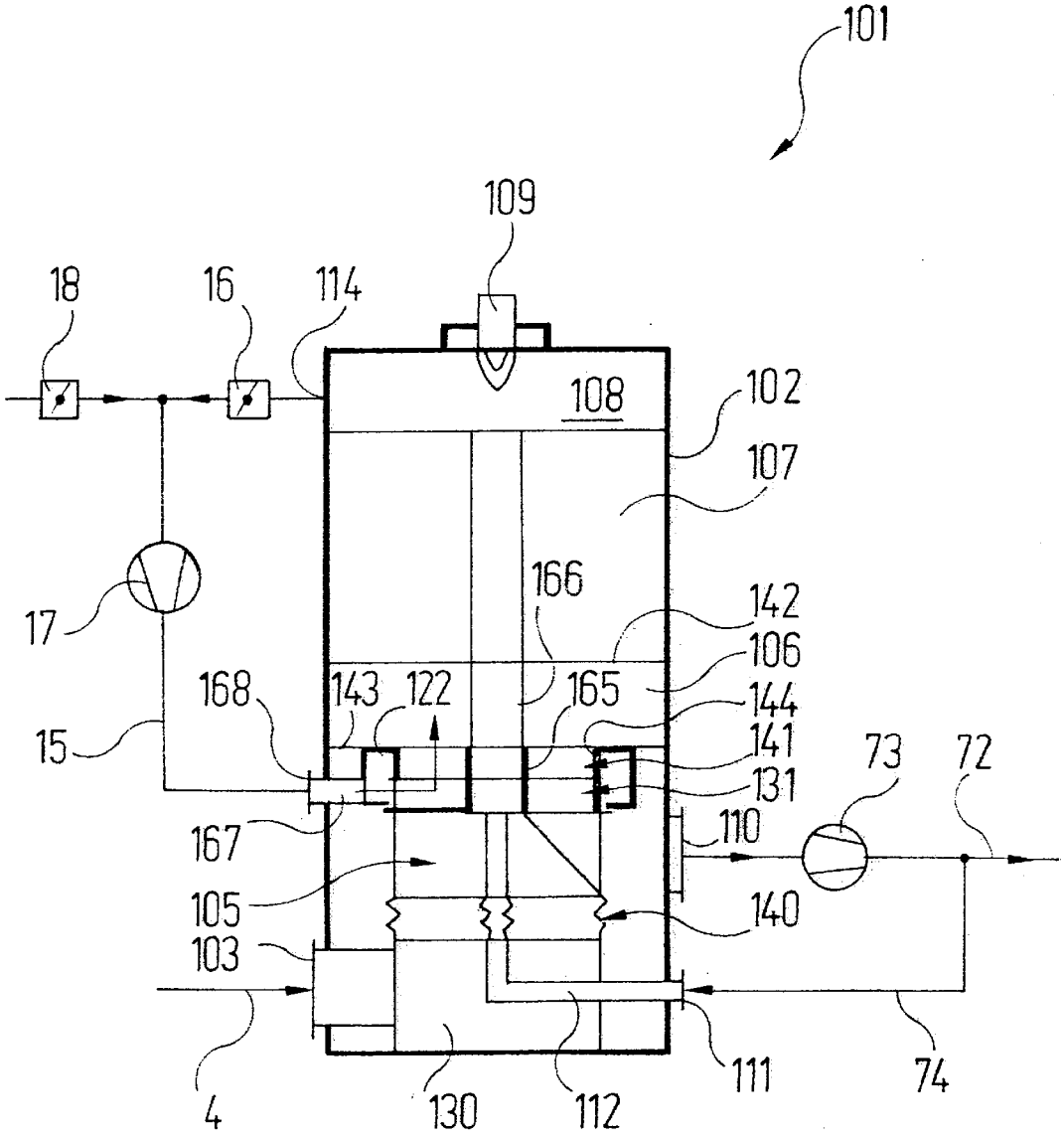
Figure 15:
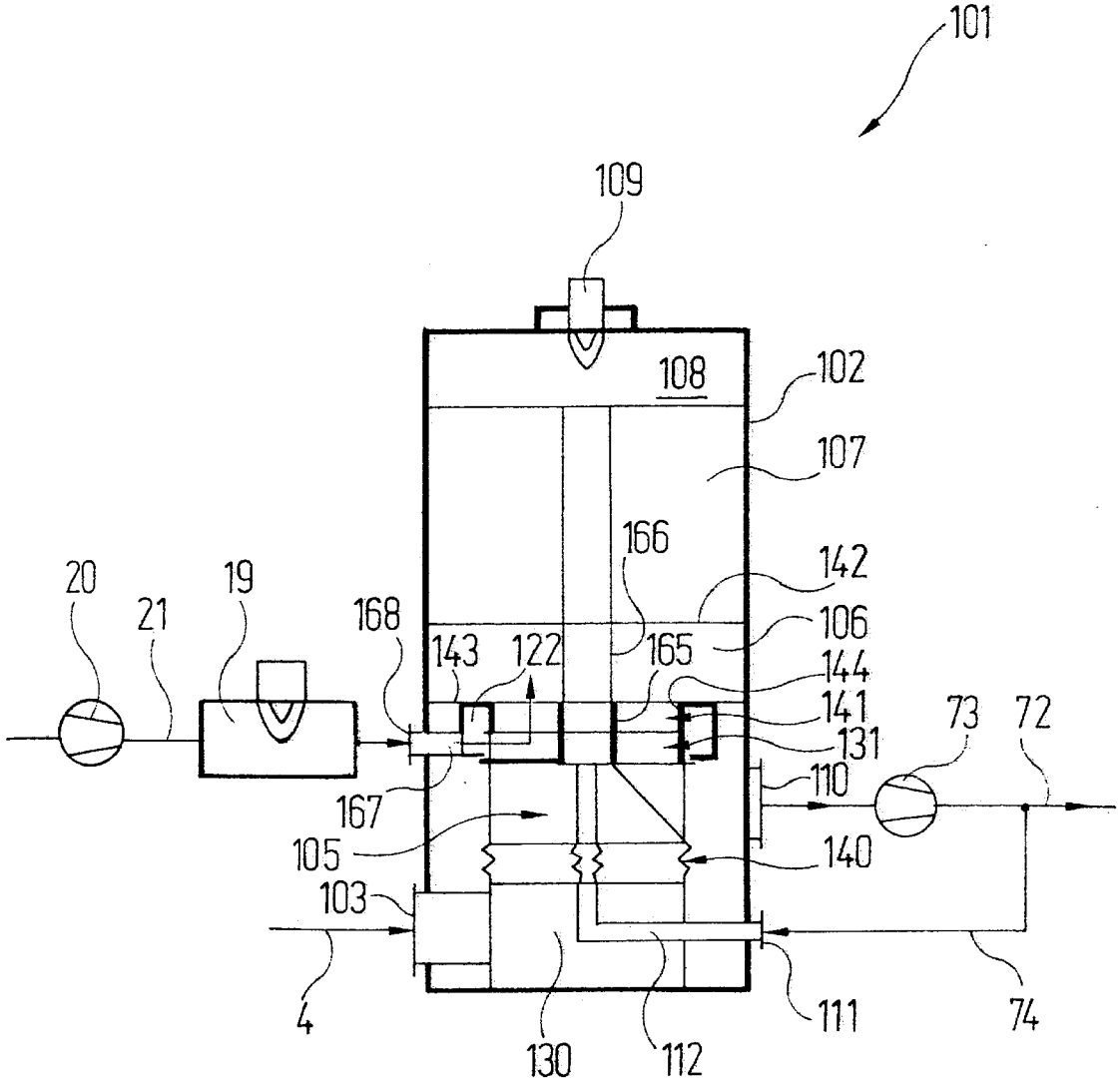
Figure 16:
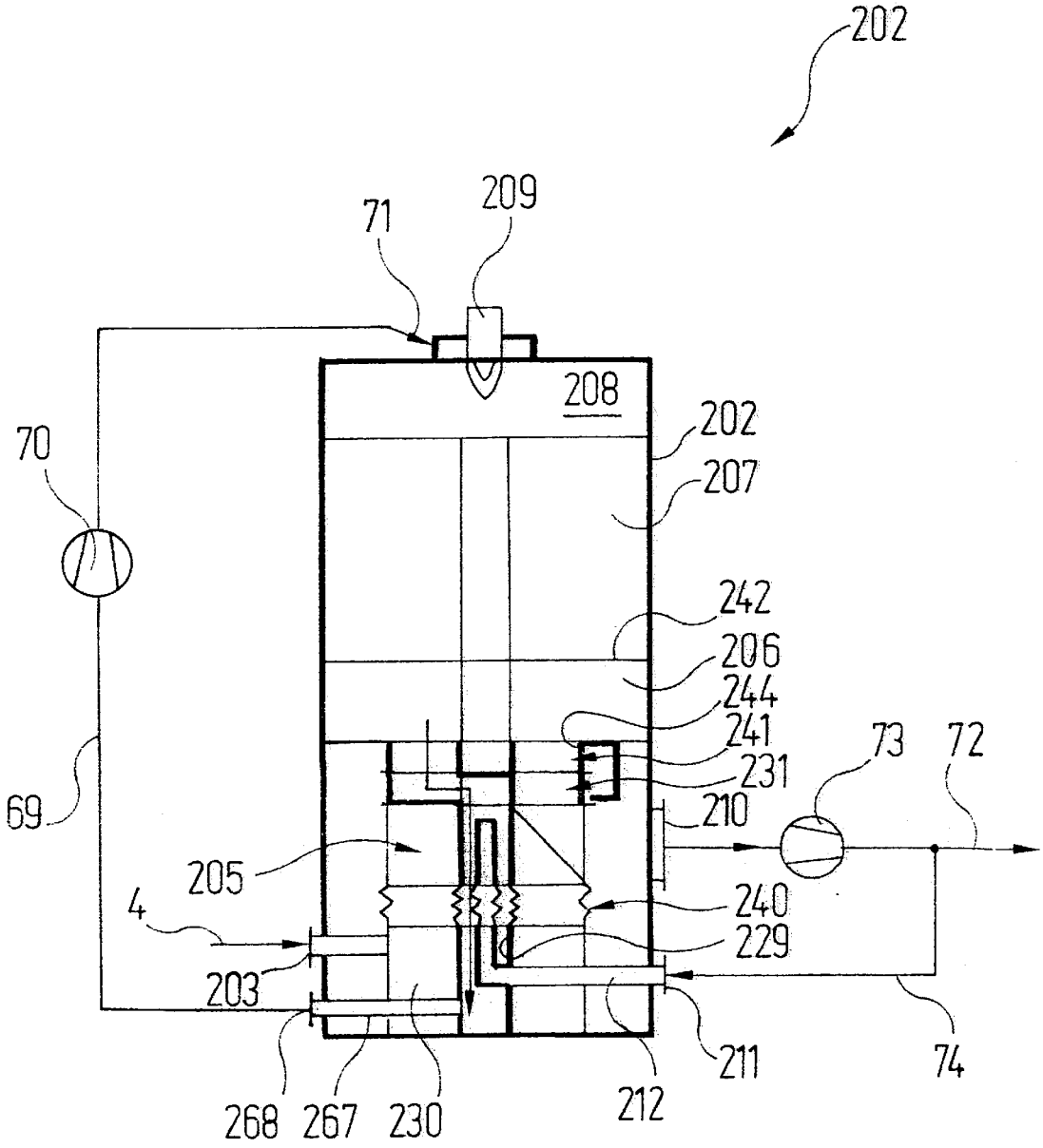
Figure 17:
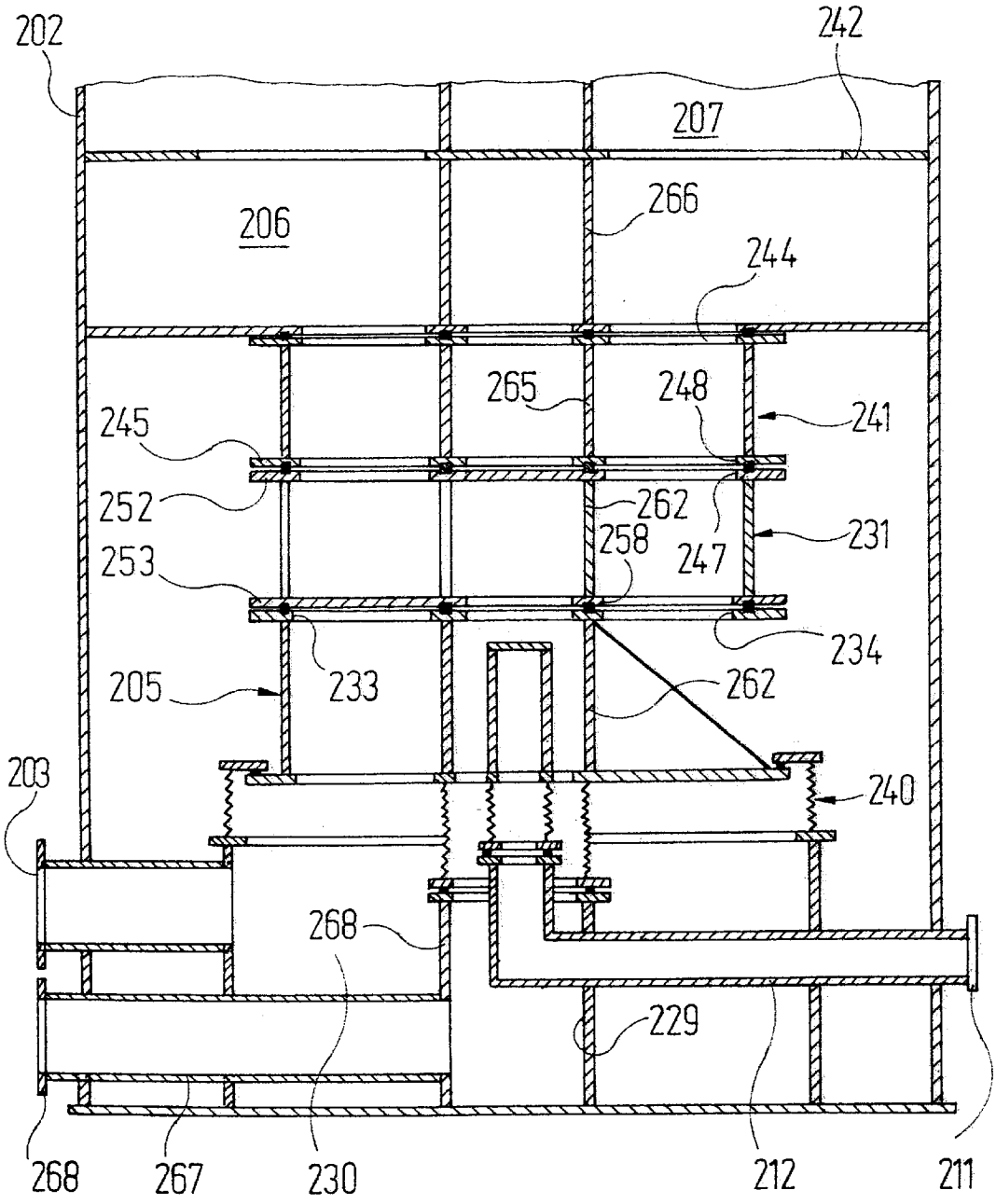
Figure 18:
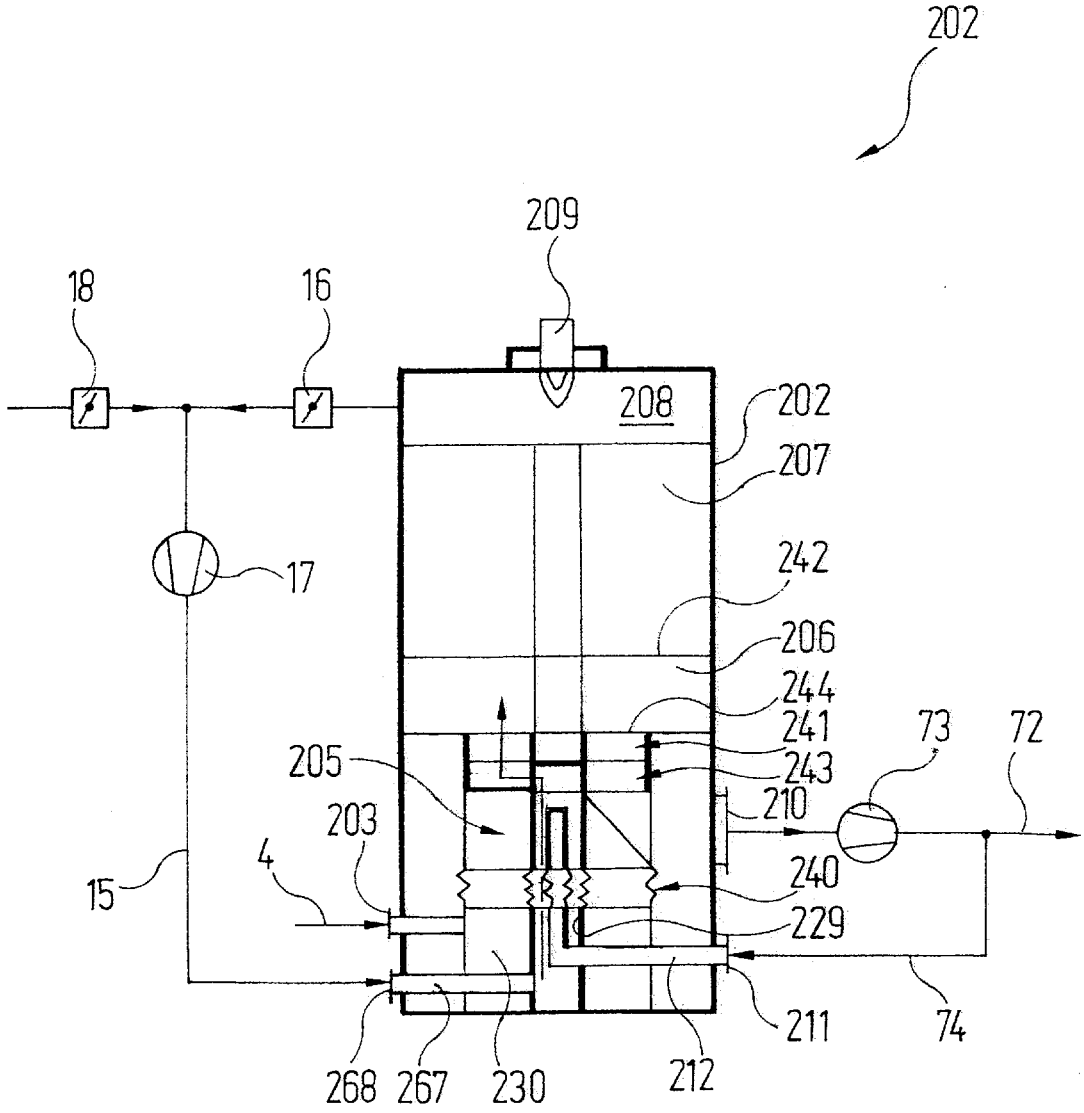
Figure 19:
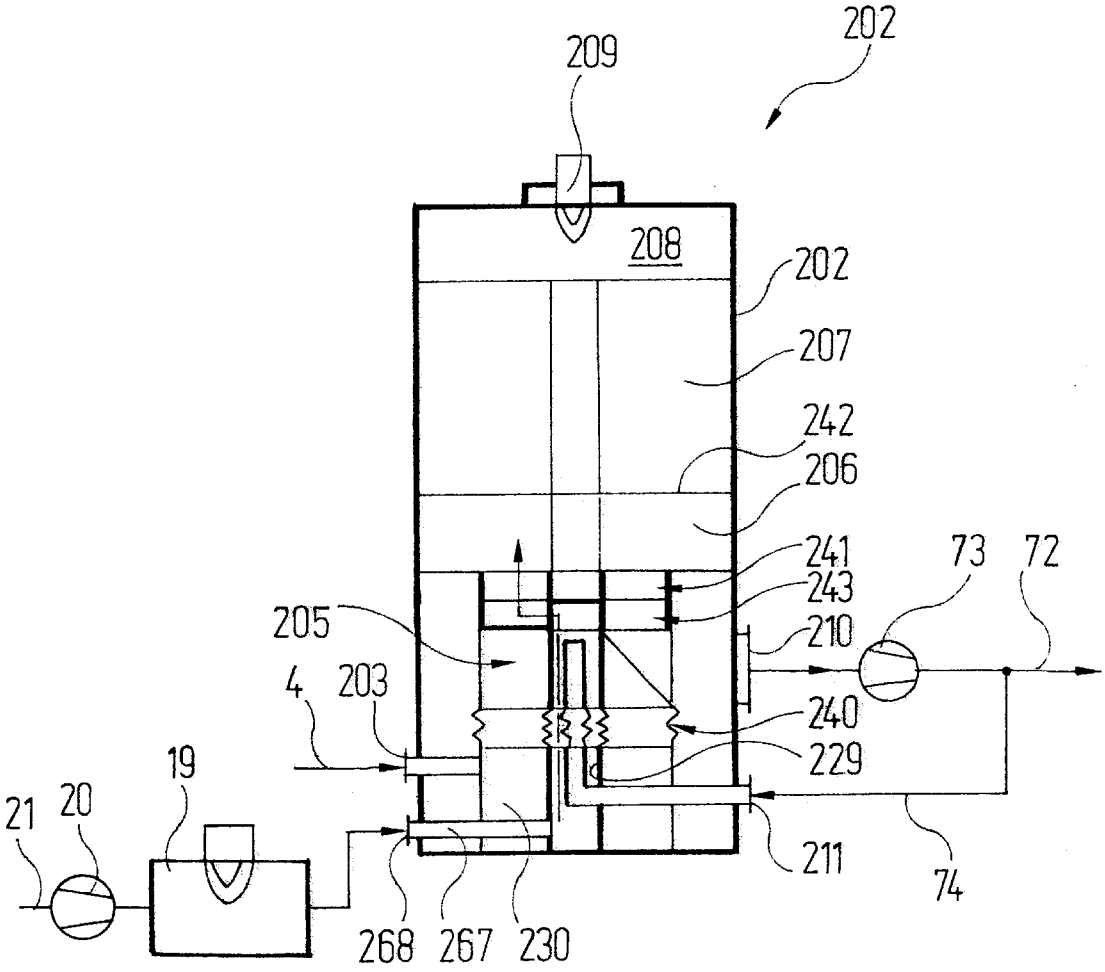

Embodiments of the invention are described in detail below with reference to the drawings; the drawings show:

FIG. 1 a diagrammatic vertical section through a regenerative post-combustion apparatus with the most important peripheral equipment needed for its operation;

FIG. 2 a partial enlargement from FIG. 1;

FIG. 3 a diagrammatic isometric view of the transfer area of the post-combustion apparatus of FIG. 1;

FIG. 4 a diagrammatic isometric view of the burn-out rotary slide valve of the post-combustion apparatus of FIG. 1;

FIG. 5 the plan view of the bottom plate of the transfer area of FIG. 3;

FIG. 6 the plan view of the top plate of the transfer area of FIG. 3;

FIG. 7 the plan view of the bottom plate of the burn-out rotary slide valve of FIG. 4;

FIG. 8 the plan view of the top plate of the burnout rotary slide valve of FIG. 4;

FIG. 9 the plan view of the rotary slide valve of the post-combustion apparatus of FIG. 1;

FIGS. 10 and 11 the post-combustion apparatus of FIG. 1 but in each case with different routes of the gas used for thermal regeneration;

FIG. 12 an alternative embodiment of a regenerative post-combustion apparatus with peripheral equipment according to FIG. 1;

FIG. 13 a partial enlargement from FIG. 12;

FIGS. 14 and 15 the post-combustion apparatus of FIG. 12 but in each case with different routes of the gas used for thermal post-combustion;

FIG. 16 a third embodiment of a regenerative post-combustion apparatus with the most important peripheral equipment;

FIG. 17 a partial enlargement from FIG. 1;

FIGS. 18 and 19 the post-combustion apparatus of FIG. 16 but in each case with different routes of the gas used for thermal regeneration.

In FIG. 1 the regenerative post-combustion apparatus is denoted as a whole by the reference character 1. Its basic construction and its basic mode of operation are—unless otherwise indicated below—described in EP 0 548 630 A1 or EP 0 719 984 A2, to which express reference is made.

Situated in the bottom region of the housing 2 of the regenerative post-combustion apparatus 1 is an inlet 3 for the outgoing air, which is to be cleaned and is supplied via the inlet line 4. Said gas passes into a plenum chamber 30, in which it flows axially—in relation to the axis of the housing 2—upwards. Through bellow expansion joints 40, which take up different degrees of thermal expansion, the gas passes into a rotating distributor 5, which may be set in continuous or intermittent rotation by means of a drive, which is not shown in FIG. 1.

The rotating distributor 5, depending on its rotational position, establishes a connection between the inlet 3 and one or more segments of a plurality of pie segments in a distribution area 6 situated in the middle region of the housing 2. The gases, on their way from the rotating distributor 5 to the various segments of the distribution area 6, additionally pass through a burn-out rotary slide valve 31, which may likewise be intermittently set in rotation in a non-illustrated manner, as well as a stationary transfer area 41; the precise design and function of burn-out rotary slide valve 31 and transfer area 41 are described in detail further below.

Situated above the distribution area 6 in the housing 2 is a heat exchanger area 7, which is subdivided into a corresponding number of segments, which communicate in each case with a corresponding segment of the distribution area 6 below. The segments of the heat exchanger area 7 are filled with heat exchanger material.

Situated above the heat exchanger area 7 in the uppermost region of the housing 2 is a combustion chamber 8, opening into which is a burner 9.

Said rough summary of the design of the post-combustion apparatus 1 is now followed by a detailed description of the components which are of most importance in the present context, namely the rotary slide valve 5, the burn-out rotary slide valve 31, the transfer area 41 and the associated internal and external lines. Here, for descriptive purposes an embodiment of the post-combustion apparatus 1 is selected, in which the heat exchanger area 7 is subdivided by radially extending dividing walls into eleven segments of equal size, i.e. each two adjacent dividing walls enclose an angle of around 32.7°. The distribution area 6 situated below is segmented in the same manner and therefore likewise comprises eleven segments of equal size, which communicate via openings 25 (cf. FIG. 2) in the dividing wall 42 between heat exchanger area 7 and distribution area 6 with the corresponding segments of the heat exchanger area 7.

The dividing wall 43, which closes off the distribution area 6 in a downward direction, is provided in the central region of each segment with an opening 26 cf. FIG. 2). Below said openings 26 the transfer area 41 illustrated in FIG. 3 is fastened. For a detailed description of the latter, reference is now made to FIGS. 3, 5 and 6.

The transfer area 41 is delimited by a top plate 44, a bottom plate 45 and a cylindrical lateral surface 46. In FIG. 3 top plate 44, bottom plate 45 and cylindrical lateral surface 46 are shown only diagrammatically by dashed outlines in order to afford a view into the interior of the transfer area 41.

The top plate 44 of the transfer area 41 shown in plan view in FIG. 6 is provided with eleven pie-segment-shaped holes 47 of equal size, between which lie strip-shaped intermediate areas 50. Each hole 47 communicates with an above-lying segment of the distribution area 6 via an opening 26 in the dividing wall 43. Situated in the centre of the plate 44 is a circular opening 27.

The bottom plate 45 of the transfer area 41 shown in FIG. 5, on the other hand, is subdivided into twelve sectors, which enclose in each case an angle of 30°. Of said twelve sectors, eleven are provided with a corresponding pie-segment-shaped hole 48 and strip-shaped intermediate areas 51 lie between said holes. The twelfth sector 49 is closed. Situated in the centre of the plate 45 is a circular opening 28.

Between the eleven holes 47 in the top plate 44 and the eleven holes 48 in the bottom plate 45 of the transfer area 41 eleven segment-like connections are then created by eleven dividing walls 49 in the following manner:

Ten of the eleven dividing walls 49 extend axially from the strip-shaped intermediate areas 50 of the top plate 44 to corresponding strip-shaped intermediate areas 51 of the bottom plate 45. The twelfth dividing wall 49 extends from the remaining strip-shaped intermediate area 50 of the top plate 44 to the centre line of the closed sector 41 of the bottom plate 45, as may be seen from FIG. 3. Since, as mentioned, the holes 47 of the top plate 44 enclose a greater angle than the holes 48 of the bottom plate 45, the dividing walls 49 extend for the most part not in an axial plane but are set obliquely towards the axis of the transfer area 45.

In radial direction the dividing walls 49 of the transfer area 41 extend from the latter's lateral surface 46 to a central tubular piece 65, which connects the circular opening 28 in the bottom plate 45 to the circular opening 27 in the top plate 44 and hence creates an axial passage through the transfer area 41.

The purpose of the transfer area 41 is to provide at its bottom plate 45 not only eleven pie-segment-shaped holes 48, which communicate with the corresponding eleven segments of the air distribution area 6 of the heat exchanger area 7, but also a closed sector surface 41, the purpose of which will be disclosed in the interaction with the burn-out rotary slide valve 31 described below.

The burn-out rotary slide valve 31 is illustrated in FIGS. 4, 7 and 8. It is delimited by a top plate 52, a bottom plate 53 and a cylindrical lateral surface 54. Top plate 52, bottom plate 53 and cylindrical lateral surface 54 are likewise shown only as dashed outlines in FIG. 4 in order to afford a view into the interior of the burn-out rotary slide valve 31.

The top plate 52 of the burn-out rotary slide valve 31 shown in FIG. 8 comprises twelve pie-segment-shaped apertures 55 of equal size, which therefore enclose in each case an angle of 30° and are separated by strip-shaped intermediate areas 56. In the centre the top plate 52 has a circular opening 57.

The bottom plate 53 of the burn-out rotary slide valve 31 shown in FIG. 7 is divided into 12 sectors of equal size, of which 11 are provided with pie-segment-shaped holes 58. The pie-segment-shaped holes 58 are separated from one another by strip-shaped intermediate areas 59. The twelfth sector 60 of the bottom plate 53 is closed. In the centre the bottom plate 53 of the burn-out rotary slide valve 31 has a circular hole 61.

As is evident from FIG. 4, a central tubular piece 62 extends axially from the circular opening 57 in the top plate 52 to the circular opening 61 in the bottom plate 53. Extending radially between the tubular piece 62 and the cylindrical lateral surface 54 are twelve dividing walls 63, which extend axially in each case from the strip-shaped intermediate areas 56 of the top plate 52 to the strip-shaped intermediate areas 59 of the bottom plate 53 and/or to the edges of the closed sector 60. This gives rise in the burn-out rotary slide valve 31 to twelve segments, of which one is blocked in a downward direction by the closed sector 60 while a passage is formed from top to bottom through the remaining eleven.

The tubular piece 62 of the burn-out rotary slide valve 31 is in communication via a radial opening 64 with the interior of the segment which is closed in a downward direction.

The rotating distributor 5 disposed underneath the burn-out rotary slide valve 31 is of a construction which is known as such. Depending on its rotational position, it establishes a connection between the plenum chamber 30 and specific segments in the burn-out rotary slide valve 31 and hence also specific segments of the transfer area 41, the distribution area 6 and the heat exchanger area 7. It moreover connects specific further segments of the burn-out rotary slide valve 31, which generally lie diametrically opposite the first-mentioned segments, and hence also further segments of the heat exchanger area 7, the distribution area 6 and the transfer area 41 to an outlet 10 (cf. FIG. 1) for cleaned gas. Finally, the rotating distributor 5 via the burn-out rotary slide valve 31 and the transfer area 41 establishes a connection between the segment of the distribution area 6, and hence of the heat exchanger area 7, which viewed in the direction of rotation of the rotating distributor 5 is in advance of the segments communicating with the outlet 10, and a scavenging air inlet 11 (cf. FIG. 1).

To enable the described connections to be established, the rotating distributor 5 comprises various apertures, of which the mouths into the top end of the rotating distributor 5 are diagrammatically illustrated in FIG. 9. The direction of rotation of the rotating distributor 5 is denoted by the arrow 32. The aperture for the outgoing air to be cleaned is denoted by the reference character 33, the aperture for the scavenging air by the reference character 34 and the aperture for the cleaned air by the reference character 35. Remaining between the various apertures 33, 34, 35 are closed, pie-segment-shaped regions 36, 37, 38 of the top end face of the rotating distributor 5, which enclose in each case an angle of 30°.

The central tubular piece 65 of the transfer area 41 (cf. FIGS. 1 to 3) is lengthened coaxially by a tubular piece 66, which extends axially through the distribution area 6. Branching off at right angles from the latter tubular piece is a further tubular piece 67, which passes radially through the distribution area 6, penetrates the shell of the housing 2 and terminates at a gas connection 68. As FIG. 1 reveals, the gas connection 68 is connected by a line 69 containing a blower 70 to an inlet 71, which is disposed at the top region of the housing 2 and leads to the combustion chamber 8.

A line 72 leads from the outlet 10 for cleaned gas via a blower 73 to the chimney no longer shown in the drawings, optionally via further intermediate treatment stations. Branching off from the line 72 downstream of the blower 73 is a line 74, which is connected to the scavenging air inlet 11.

The described regenerative post-combustion apparatus 1 operates as follows:

"Normal operation" in the following is to be understood as the mode of operation, in which in a known manner the contaminated waste gases supplied via the line 4 are afterburnt in the combustion chamber 8 and, after an exchange of heat in the various segments of the heat exchanger area 7, are discharged via the gas outlet 10 and the line 72 to the chimney. During said "normal operation" the burn-out rotary slide valve 31 is situated in such a relative position underneath the transfer area 41 that its segment, which is closed at the bottom by the sector 60, comes to lie below the closed sector surface 49 of the transfer area 41. In said position, therefore, the downwardly closed segment of the burn-out rotary slide valve 31 communicates neither axially in a downward direction nor axially in an upward direction. Thus, no gas at all flows via the opening 64, the interior of the tubular piece 62 of the burn-out rotary slide valve 31, the interior of the tubular piece 65 of the transfer area 41 and the tubular pieces 66 and 67 in the distribution area 6 in an outward direction to or from the gas connection 68.

The rotating distributor 5 rotates underneath the burn-out rotary slide valve 31 usually either continuously or intermittently from segment to segment, wherein sequentially the waste gas to be cleaned is conveyed in accordance with the position of the aperture 33 in the rotating distributor 5 into the corresponding segments of the burn-out rotary slide valve 31, the transfer area 41, the distribution area 6 and the heat exchanger area 7 and into the combustion chamber 8. There, the gases are afterburnt in a known manner and then returned through the segments of the heat exchanger area 7, the distribution area 6, the transfer area 41 and the burn-out rotary slide valve 31 which communicate with the aperture 34 of the rotating distributor 5. From there, the now cleaned waste gases then pass through the outlet 10, having been drawn off by the blower 73, via the line 72 to the chimney.

Some of the cleaned gases is returned via the line 74 to the scavenging air inlet 11 and from there is introduced via an angled line 12, which extends first through the plenum chamber 30 and then centrally in axial direction through the bellow expansion joints 40, along a path (not shown in the drawings) into the segment of the rotating distributor 5 corresponding to the scavenging air aperture 34. Said air then flows to a segment of the transfer area 41, the distribution area 6 and the heat exchanger area 7. The heat exchanger material contained in said segment of the heat exchanger area 7 is swept by the cleaned pure air, which removes residues of the waste gas, which previously flowed through the relevant segment of the heat exchanger area 7, and passes into the combustion chamber 8 where it is afterburnt again.

It is clear that the described "normal operation" of the regenerative post-combustion apparatus 1 in no way differs from that of known post-combustion devices. A minor difference is that the effective free flow area for the gases is always slightly reduced when one of the apertures 33, 34, 35 of the rotating distributor 5 overlaps the segment of the burn-out rotary slide valve 31 which is blocked by the closed sector 60. Since, even in said case, the flow areas are still sufficiently large, there are no further repercussions on the cleaning of the waste gases.

"Regenerative operation" in the following is to be understood as the mode of operation, in which—besides the ongoing cleaning of waste gases—a specific segment inside the heat exchanger area 7 is additionally thermally regenerated. For said purpose, the burn-out rotary slide valve 31 is moved out of the described position, in which the downwardly closed segment is "parked" below the sector region 41 of the transfer area 41, into a position below the opening 48 of the transfer area 41 which communicates with the segment of the heat exchanger area 7 to be regenerated.

Said segment is then excluded from the normal process of being swept by waste gas to be cleaned and/or by pure gas. Instead, hot gas from the combustion chamber 8 is sucked through the relevant segment of the heat exchanger area 7 and flows through the corresponding segments of the distribution area 6, the transfer area 41 and the downwardly closed segment of the burn-out rotary slide valve 31 into the interior of the central tubular piece 62 of the burn-out rotary slide valve 31 and from there via the central tubular piece 65 of the transfer area 41, the tubular pieces 66 and 67 in the distribution chamber 6 to the gas outlet 68. Via the line 69 said gases are conveyed with the aid of the blower 70 to the inlet 71 and hence back into the combustion chamber 8, where afterburning occurs.

The described circulation of the air through the segment of the heat exchanger area 7 to be regenerated continues until all impurities have been removed from the heat exchanger material of said segment. Afterwards—depending on requirements—the burn-out rotary slide valve 31 may be rotated into a position below another hole 48 of the transfer area 41 associated with another segment of the heat exchanger area 7 to be regenerated. In said manner, all of the segments of the heat exchanger area 7 in succession may be thermally regenerated without interrupting the cleaning operation of the regenerative post-combustion apparatus 1; the latter continues to operate in parallel, albeit with a slightly reduced capacity because the segment of the heat exchanger area 7 in the process of being regenerated does not participate in the cleaning operation.

Once impurities have been removed from all segments of the heat exchanger area 7 in said manner, the burn-out rotary slide valve 31 is moved back into its "parking position", in which its segment closed in a downward direction by the sector 60 lies below the closed sector 41 of the transfer area 41.

The flow direction of the gas which effects thermal regeneration of the heat exchanger material in the heat exchanger area 7 may alternatively be reversed in comparison to the arrangement shown in FIG. 1. This is diagrammatically illustrated in FIG. 10. The post-combustion apparatus 1 is unaltered compared to FIG. 1. However, instead of the gas used for thermal regeneration being sucked out of the combustion chamber 8 directly into the heat exchanger area 7, it is removed from the combustion chamber 8 via a lateral outlet 14. The hot combustion gas is conveyed via a line 15, which contains a butterfly control valve 16 and a blower 17, to the gas connection 68. To adjust the correct temperature, fresh air is introduced from the outside atmosphere via a further butterfly control valve 18 into the line 15 and is added to the hot gas leaving the combustion chamber 8.

The path, which said gas subsequently follows from the gas connection 68, is then the opposite of the flow path described above with reference to FIG. 1. The segments of the heat exchanger area 7 are in said case, unlike in the embodiment of FIG. 1, swept from the bottom up. This has the advantage that the hot gases first reach the bottom regions of the heat exchanger material remote from the combustion chamber 8. In said manner, a homogeneous temperature required for detachment of the impurities may be attained more.easily and more rapidly in the heat exchanger material. The gases emerging from the top of the heat exchanger area 7 and laden with impurities detached from the heat exchanger material are afterburnt jointly with the waste gas, which is situated in the normal cleaning process, in the combustion chamber 8.

Whereas in the embodiments illustrated in FIGS. 1 to 10 the gas used for thermal regeneration of the heat exchanger material was heated in the combustion chamber 8, in the embodiment of FIG. 11 the gas is heated by a separate burner 19, to which fresh air is supplied with the aid of a blower 20 via a line 21. The path, which the thus heated gas subsequently follows from the gas connection 68 inside the regenerative post-combustion apparatus 1, which is otherwise identical to that of FIGS. 1 and 10, is the same as in FIG. 10.

FIG. 12 shows an axial section through a second embodiment of a regenerative post-combustion apparatus, which is very similar to that of FIG. 1. Identical parts are therefore denoted by the same reference characters as in FIG. 1, plus 100.

The regenerative post-combustion apparatus 101 of FIG. 12 differs from that of FIG. 1 exclusively in the manner in which the gas used for thermal regeneration is conveyed in the region of the burn-out rotary slide valve 131. Whereas in the embodiment of FIG. 1, as mentioned above, the segment of the burn-out rotary slide valve 31 which is closed in a downward direction by the sector 60 was open radially in towards the central tubular piece 62, in the embodiment of FIG. 12 there is no connection in said direction, as is particularly evident also from the partial enlargement of FIG. 13. Instead, the relevant segment is open in a radially outward direction; the cylindrical lateral surface 154 of the burn-out rotary slide valve 131 therefore has at said point an opening 121. The burn-out rotary slide valve 31 is surrounded by an annular channel 122, which is rigidly fastened to the housing 102 and/or the dividing plate 143 at the underside of the distribution area 106. A tubular piece 167 connects the annular channel 122 to the gas connection 168 at the outside of the housing 102.

Said design change leads to a slight modification of the flow path of the hot air used for thermal regeneration. In the arrangement of the peripheral equipment, which is selected in FIG. 12 and corresponds to that of FIG. 1, said gas flows out of the downwardly closed segment of the burn-out rotary slide valve 31 radially outwards into the annular channel 122 and from there via the tubular piece 167, the gas connection 168 in the already previously described manner to the line 169 and via the blower 170 to the gas inlet 171.

In the thermal post-combustion apparatus 101 of FIG. 12 said gas route may be reversed in the same manner as is illustrated in FIG. 10 for the first described embodiment of a thermal post-combustion apparatus 1. This is shown in FIG. 14. It is naturally also possible in the thermal post-combustion apparatus 102, as in the FIG. 11 discussed above, for the air used for thermal regeneration to be removed directly from the outside atmosphere and supplied via a blower 120 and a burner 119 to the gas inlet 168. This is illustrated in FIG. 15.

FIGS. 16 and 17 show a third embodiment of a thermal post-combustion apparatus, which again bears a close similarity to the embodiment of FIG. 1. Identical parts are therefore provided with the same reference characters, plus 200. Again, the only difference is the route of the gas used for thermal regeneration in the region of the burn-out rotary slide valve 131. Whereas, in the embodiment first described, the interior of the central tubular piece 62 of the burn-out rotary slide valve 31 communicated with the above-lying central tubular piece 65 of the transfer area 41, in the embodiment of FIGS. 16 and 17 the central tubular piece 262 of the burn-out rotary slide valve 231 is closed in an upward direction and open in a downward direction. It communicates, here, with a pipe 229, which extends coaxially with the housing 2 and in sections also coaxially with the scavenging air line 212 through the bellow expansion joints 240 to the underside of the housing 202. There, a line 267 branches off at right angles and leads radially outwards to a gas connection 268.

The gas connection 268 is connected in the same manner as in FIGS. 1 and 12 via a blower 270, which lies in a line 269, to the top inlet 271 of the thermal post-combustion apparatus 201.

FIG. 18 shows a route of the gas used for thermal regeneration which corresponds to that in the FIGS. 10 and 14 described above; FIG. 19 shows the use of air, which is removed from the outside atmosphere and heated in a separate burner 219, in accordance with FIGS. 11 and 15, to which reference is made.

What is claimed is:

1. A regenerative post-combustion apparatus, which in a housing comprises from top to bottom:

a) a combustion chamber;

b) a heat exchanger area, which is subdivided into a plurality of segments filled with heat exchanger material;

c) a rotating distributor, which depending on its rotational position establishes:

ca) a connection between an inlet for waste gas to be cleaned and at least one first segment of the heat exchanger area;

cb) a connection between at least one second segment of the heat exchanger area and an outlet for cleaned gas, wherein a device for thermal regeneration of the heat exchanger material is provided, by means of which hot clean gas may be conveyed through selected segments of the heat exchanger area until the impurities, which have become attached to the heat exchanger material, detach from the latter; wherein the device for thermal regeneration comprises:

d) a burn-out rotary slide valve (31; 131; 231), which is disposed above the rotating distributor (5; 105; 205) and comprises segments separated by dividing walls (63), wherein da) at least one of the segments of the burn-out rotary slide valve (31; 131; 231) is open in an upward direction and closed in the direction of the rotating distributor (5; 105; 205) and communicates with an outlet (68; 168; 268), while db) the other segments of the burn-out rotary slide valve (31; 131; 231) are open in an upward and downward direction;

e) a driving device, by means of which the burn-out slide valve (31; 131; 231) may be rotated in such a way underneath the heat exchanger area (7; 107; 207) that its downwardly closed segment may be brought selectively into communication with each segment of the heat exchanger area (7; 107; 207).

2. A regenerative post-combustion apparatus as claimed in claim 1, in which the heat exchanger area is subdivided into n segments, wherein a) the burn-out rotary slide valve (31; 131; 231) is subdivided into (n+1) segments, of which n are open in an upward and downward direction and one is open in an upward direction and closed in a downward direction;

b) provided in the flow path between the burn-out rotary slide valve (31; 131; 231) and the heat exchanger area (7; 107; 207) is a transfer area (41; 141; 241), which ba) at its top side is subdivided into n sectors, which each enclose an angle of 360°/n and have a through-opening (47), which communicates with one of the n segments of the heat exchanger area (7; 107; 207);

bb) at its bottom side is subdivided into (n+1) sectors, which each enclose an angle of 360°/(n+1), wherein n of said sectors have a through-opening (48), which depending on the rotational position of the burn-out rotary slide valve (31; 131; 231) may communicate with each of the latter's (n+1) segments, while one sector is closed and in a specific rotational position of the burn-out rotary slide valve (31; 131; 231) is positioned above the latter's downwardly closed segment;

bc) has n dividing walls (49), which in part extend obliquely in such a manner from the top side to the bottom side of the transfer area (41; 141; 241) that the latter is subdivided into n segments, which at the top and bottom side each have a through-opening (47, 48), wherein at least one of said segments at its bottom side is delimited at least partially by the closed sector.

3. A regenerative post-combustion apparatus as claimed in claim 1, wherein the burn-out rotary slide valve (31; 231) comprises a central tubular piece (62; 262), the interior of which communicates via an opening (64) in its lateral surface with the downwardly closed segment of the burn-out rotary slide valve (31; 231).

4. A regenerative post-combustion apparatus as claimed in claim 3, wherein the central tubular piece (65) of the burn-out rotary slide valve (31) is closed in a downward direction and communicates at the top with a coaxial central tubular piece (66) of the above-lying component (41), which communicates with the connection (68).

5. A regenerative post-combustion apparatus as claimed in claim 3, wherein the central tubular piece (265) of the burn-out rotary slide valve (231) is closed in an upward direction and communicates at the bottom with a coaxial central tubular piece (266) of the component (205) below, which communicates with the connection (268).

6. A regenerative post-combustion apparatus as claimed in claim 1, wherein the downwardly closed segment of the burn-out rotary slide valve (131) has in its lateral surface an opening (121), via which it communicates with a stationary annular channel (122), which surrounds the burn-out rotary slide valve (131) and in turn communicates with the connection (168).

* * * * *